US009067411B2

(12) United States Patent
Kasai et al.

(10) Patent No.: US 9,067,411 B2
(45) Date of Patent: Jun. 30, 2015

(54) LIQUID DISCHARGE HEAD

(71) Applicant: CANON KABUSHIKI KAISHA, Tokyo (JP)

(72) Inventors: Ryo Kasai, Tokyo (JP); Nobuyuki Hirayama, Fujisawa (JP); Kengo Umeda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/012,805

(22) Filed: Aug. 28, 2013

(65) Prior Publication Data

US 2014/0063128 A1 Mar. 6, 2014

(30) Foreign Application Priority Data

Aug. 31, 2012 (JP) ..... 2012-191429

(51) Int. Cl.
*B41J 29/38* (2006.01)
*B41J 2/05* (2006.01)
*B41J 2/045* (2006.01)

(52) U.S. Cl.
CPC ..... *B41J 2/04548* (2013.01); *B41J 2/04528* (2013.01); *B41J 2/04541* (2013.01); *B41J 2/04543* (2013.01); *B41J 2/04568* (2013.01); *B41J 2/0458* (2013.01)

(58) Field of Classification Search
CPC ..... B41J 2/35; B41J 2/3551; B41J 2/3553; B41J 2/38; B41J 2/335; B41J 2/33505; B41J 2/04588; B41J 2/04581
USPC ..... 347/56; 34/10
See application file for complete search history.

(56) References Cited

U.S. PATENT DOCUMENTS

| | | | | |
|---|---|---|---|---|
| 4,492,966 | A * | 1/1985 | Seki et al. | 346/33 A |
| 5,917,509 | A * | 6/1999 | Becerra et al. | 347/11 |
| 6,471,324 | B1 * | 10/2002 | Maru | 347/19 |
| 6,488,350 | B2 * | 12/2002 | Iwasaki et al. | 347/12 |
| 6,612,672 | B2 * | 9/2003 | Yasuda | 347/12 |
| 7,036,914 | B1 * | 5/2006 | Axtell et al. | 347/57 |
| 7,770,989 | B2 * | 8/2010 | Matsui et al. | 347/9 |
| 8,590,995 | B2 * | 11/2013 | Sayama | 347/10 |
| 2012/0086755 | A1 * | 4/2012 | Sayama | 347/54 |

FOREIGN PATENT DOCUMENTS

| | | | |
|---|---|---|---|
| JP | 7-68761 | A | 3/1995 |
| JP | 2002-292875 | A | 10/2002 |

* cited by examiner

*Primary Examiner* — Matthew Luu
*Assistant Examiner* — Patrick King
(74) *Attorney, Agent, or Firm* — CANON USA INC IP DIVISION

(57) ABSTRACT

A liquid discharge head includes a first unit configured to supply power, and a second unit including an input unit to which the power is input, a plurality of heaters connected to the input unit via a common power source line and configured to discharge liquid, an energization unit configured to energize the plurality of heaters, and a selection unit configured to select a target heater from the heaters for discharging liquid to be energized in turn by the energization unit for a period corresponding to a time interval at which liquid is discharged, wherein the selection unit further selects non-target heaters from the heaters to be energized different from the heater targeted for use for discharging liquid before and after the target heater is energized.

6 Claims, 12 Drawing Sheets

LIQUID DISCHARGE HEAD

BACKGROUND

1. Technical Field

Aspects of the present invention relate to a liquid discharge head for discharging liquid.

2. Description of the Related Art

Voltage is applied to a recording element (a heater) provided on a liquid discharge head to cause the heater to generate heat, causing a discharge port (a nozzle) to discharge liquid. The voltage applied to the recording element (the heater) is supplied by a power source provided on a recording apparatus, to which the liquid discharge head is attached. Such control for discharging liquid from the discharge port has been performed to this date. Japanese Patent Application Laid-Open No. 2002-292875 discusses that a recording element substrate (an element substrate) is provided with a power source regulator for feedback to keep the voltage applied to the heater constant. Japanese Patent Application Laid-Open No. 07-68761 discusses that the timing of a heat signal for driving a heater is shifted within the range of a period 1107 as illustrated in a signal 1101 in FIG. 12 to reduce a noise level occurring in driving a plurality of heaters at the same time.

FIG. 10 illustrates an example in which power is supplied to the recording element (the heater) provided on the liquid discharge head. A flexible flat cable (FFC) 802 and a flexible printed-circuit board (FPC) 805 are provided on a power source line for supplying power from a power source substrate 801 to an element substrate 807. The FFC 802 and the FPC 805 have a parasitic impedance 902. Driving a plurality of heaters causes a problem that the parasitic impedance 902 makes rising and falling waveforms of a current pulse of the heater dull as illustrated in FIG. 11.

In the recording apparatus, a distance between the surface of the element substrate 807 and a recording medium 808 is short. Furthermore, an ink flow path is formed on the back of the element substrate 807. This makes it difficult to arrange a component for reducing the parasitic impedance 902 (for example, a bypass capacitor) near the element substrate 807. For this reason, the parasitic impedance 902 cannot be removed.

Even if the configuration discussed in Japanese Patent Application Laid-Open No. 2002-292875 is adopted, the dullness of rising and falling waveforms caused by the parasitic impedance 902 outside the element substrate 807 cannot be inhibited.

Even if the configuration discussed in Japanese Patent Application Laid-Open No. 07-68761 is adopted, and if attention is focused on current flowing to one heater, periods during which much current such as current 1105 and 1106 illustrated in FIG. 12 flows are caused. Thereby, a current waveform different for each heater is applied to heaters to make the discharge amount of ink different, as a result, degrading the quality of an image to be recorded on the recording medium.

SUMMARY

According to an aspect of the present invention, a liquid discharge head includes a first unit configured to supply power, and a second unit including an input unit to which the power is input, a plurality of heaters connected to the input unit via a common power source line and configured to operate to discharge liquid, an energization unit configured to energize the plurality of heaters, and a selection unit configured to select the heaters so that a heater targeted for use for discharging liquid is energized in turn by the energization unit for a period corresponding to a time interval at which liquid is discharged, wherein the selection unit selects the heaters to energize heaters non-targeted for use for discharging liquid, different from the heater targeted for use for discharging liquid, before and after the heater targeted for use for discharging liquid is energized.

Further features of the present invention will become apparent from the following description of exemplary embodiments with reference to the attached drawings.

DESCRIPTION OF THE EMBODIMENTS

Figure 1:
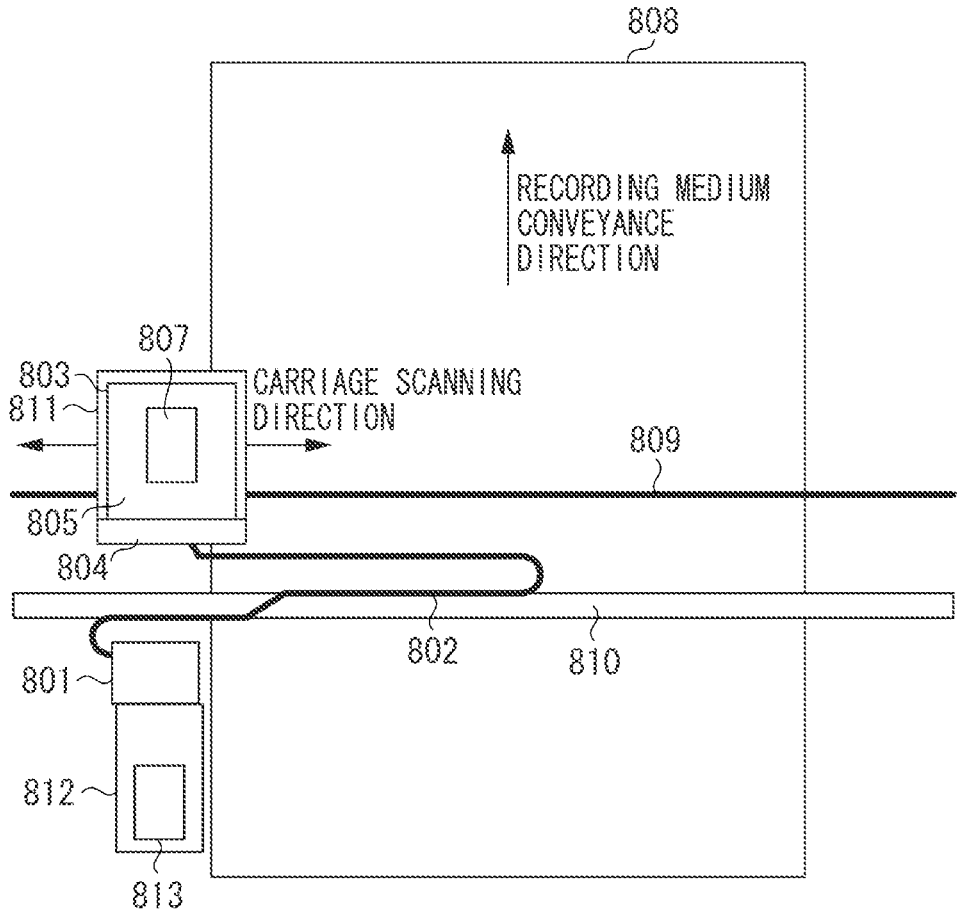
FIG. 1 illustrates a schematic diagram of an inkjet recording apparatus.

FIG. 1 illustrates a schematic diagram of an inkjet recording apparatus (a serial type recording apparatus) for discharging liquid such as ink. A carriage motor (not illustrated) is driven to move a liquid discharge head 803 mounted on a carriage 811 in a scanning direction with respect to a recording medium 808 along a guide rail 809. Liquid such as ink is discharged from a discharge port (a nozzle) of the liquid discharge head 803 to form an image on the recording medium 808. A conveyance motor (not illustrated) is driven to convey the recording medium 808 on which the image is formed in a conveyance direction. A carriage substrate 804 is provided on the carriage 811 and connected to a power source substrate 801 and a control substrate 812 via a flexible flat cable (FFC) 802. A part of the FFC 802 is arranged along a main-body frame 810. The carriage substrate 804 is electrically connected to a flexible printed-circuit board (FPC) 805 provided on the liquid discharge head and electrically connected to an element substrate 807 via a wire bonding 806. The FPC 805 and the wire bonding 806 are represented as a first unit, and the element substrate 807 is represented as a second unit.

Figure 2:
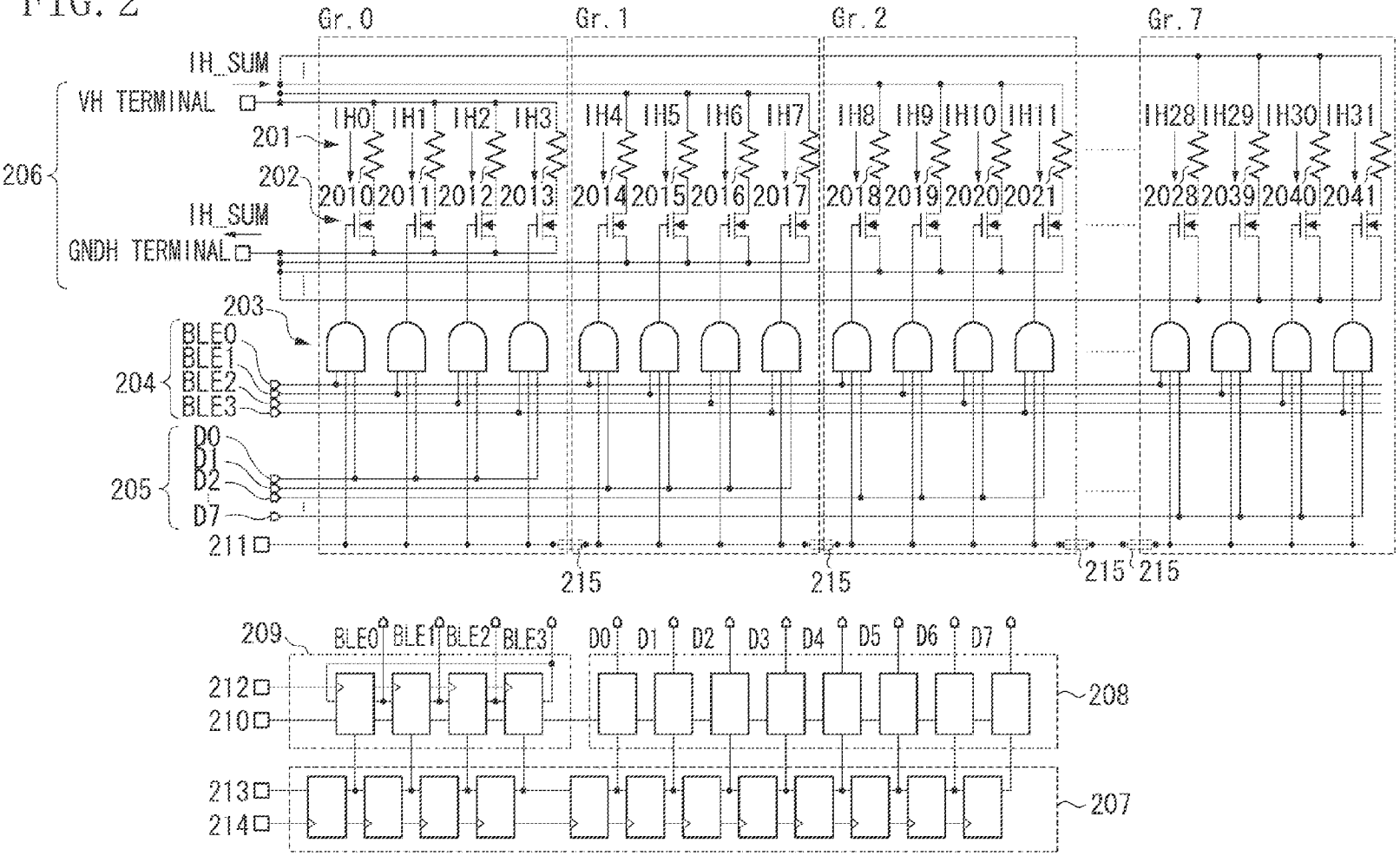
FIG. 2 illustrates an internal configuration of an element substrate according to a first exemplary embodiment.

FIG. 2 illustrates an internal configuration of the element substrate 807 according to a first exemplary embodiment. The element substrate 807 includes a plurality of heaters 201 for discharging ink, a plurality of switches (drivers) 202 which is provided in association with the heaters 201 and energizes the heaters 201, and AND circuits 203 provided in association with the switches 202. The element substrate 807 further includes a shift resistor 207, a latch 208, and a ring shift register 209. The switch 202 is a metal oxide semiconductor (MOS) transistor, for example. The output signal of the AND circuit 203 is input to the gate terminal of the MOS transistor. When the output signal of the AND circuit 203 is in a high level state, current flows to the heater 201. As illustrated in FIG. 2, the element substrate 807 includes a plurality of groups (eight groups) (Ge.0 to Gr.7). In FIG. 2, if attention is focused on one group, four heaters 2010 to 2013 of a group 0 (Gr.0) are connected to a VH terminal via a common power line. Similarly, four heaters of each of other groups are connected to the VH terminal via the common power line. The four drivers 202 are connected to a GNDH terminal via a common ground line. Thus, the power supply line is allocated to each group. Current IH_SUM is input from the VH terminal and current IH_SUM is output from the GNDH terminal according to the energization of the heater.

A block selection signal 204 is a signal for selecting a heater to be energized in one group (a heater targeted for energization). The outputs of the ring shift register 209 and the latch 208 are connected to the input of the AND circuit 203. Image data are input from a DATA terminal 213 and a clock signal is input from a clock (CLK) terminal 214. The image data are input in synchronization with the clock signal. The image data input to the shift resistor 207 at the timing when the latch signal (a pulse signal) outputs are stored in the latch 208. The block selection signal 204, a group selection signal 205, a heat signal (HE), and a switching signal (BLE_SHIFT) are transferred from a control unit 813 illustrated in FIG. 1 to the element substrate 807 via the FFC 802. Similarly, a latch signal (LT), image data (DATA), and a clock signal (CLK) are also transferred to the element substrate 807 via the FFC 802.

The AND circuit 203 receives the block selection signal 204, the group selection signal 205, and the heat signal, and outputs the results of logical product (AND processing) to the driver 202 corresponding to the AND circuit 203. The driver 202 energizes the heater while the signal output by the AND circuit 203 is in a high level state.

The block selection signal 204 is data for bringing one of the block selection signals BLE0 to BLE3 into a signal in a high level state. The block selection signal 204 is repeated with a period of four blocks (BLK0, BLK1, BLK2, and BLK3). Driving the heater enables all of the heaters 201 to be selected.

Figure 3:
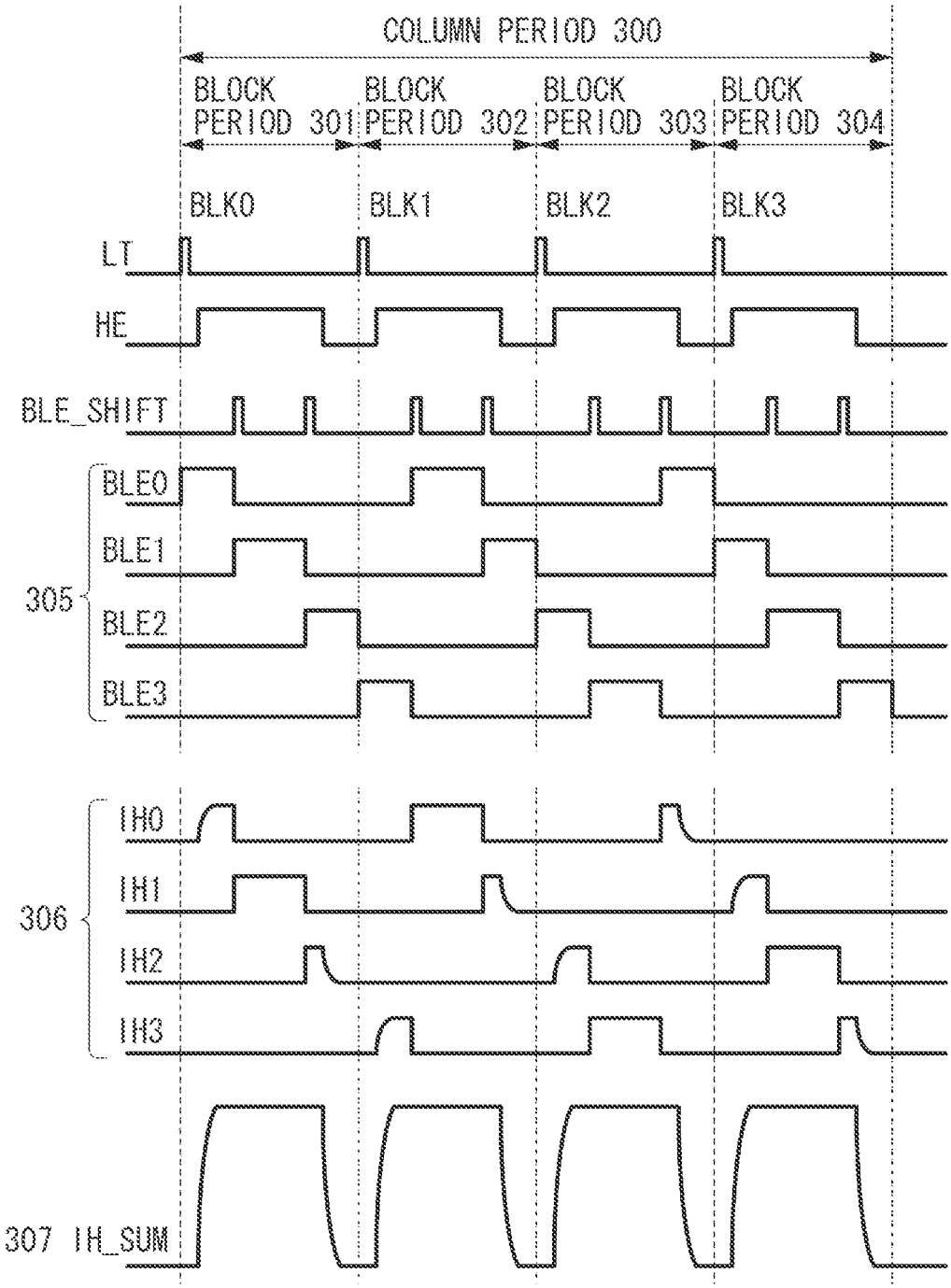
FIG. 3 illustrates an operation of the element substrate according to the first exemplary embodiment.
Figure 4A:
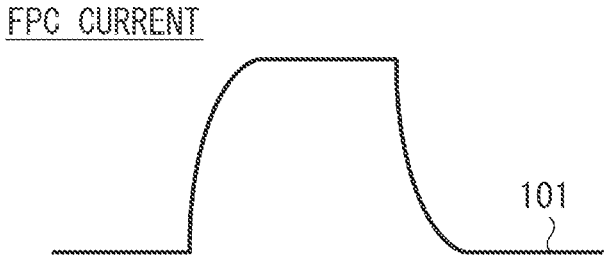
FIGS. 4A, 4B, 4C, and 4D illustrate current waveforms of heaters according to the first exemplary embodiment.
Figure 4B:
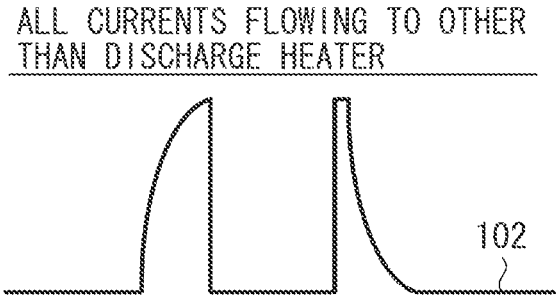
Figure 4C:
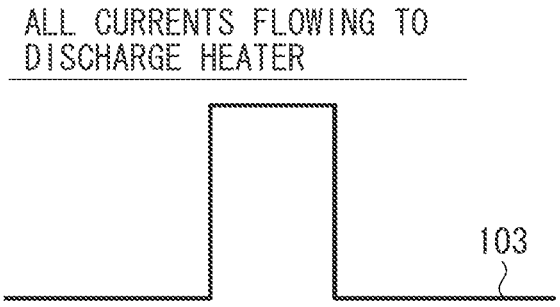
Figure 4D:
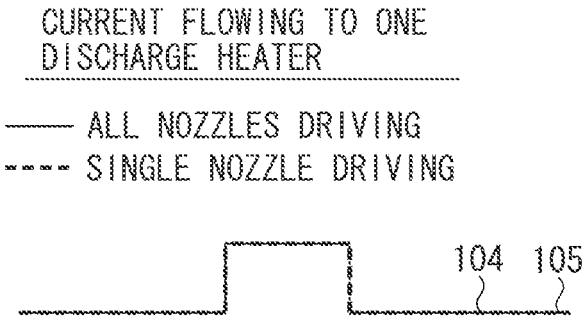

FIG. 3 is a timing chart of the circuit illustrated in FIG. 2. A column period (a first period) 300 is allocated to four block periods (a second period) 301 to 304. In other words, the column period 300 corresponds to the time interval of ink discharge. In the case of a serial-type recording apparatus, the column period 300 corresponds to one column interval, for example. The heater 201 targeted for use for recording (a heater targeted for use for discharging ink) is energized in any of the block periods. Thus, time-division drive is performed as the energization (driving) of the heater 201. In FIG. 3, description is made with attention focused on the group 0 (Gr.0) illustrated in FIG. 2. A block selection signal 305 in FIG. 3 corresponds to the block selection signal 204 in FIG. 2 and denotes a logic level (logic state) of each signal.

The input of a pulse BLK0 of a latch signal (LT) starts a block period 301. In the block period 301, when a switching signal (BLE_SHIFT) is input, the ring shift register 209 switches the block selection signal 204 in a high level state. For example, the ring shift register 209 switches the block selection signal 204 in the order of BLE0, BLE1, and BLE2. The width of a high-level period of the BLE1 is determined as a time width for which ink can be discharged (a time width corresponding to the heat quantity by which ink can be discharged). The width of a high-level period of the BLE0 and the width of a high-level period of the BLE2 are determined as a time width for which ink cannot be discharged (a time width corresponding to the heat quantity by which ink cannot be discharged). The period between the two rising edges of the switching signal is a driving period for the heater of the nozzle targeted for discharging ink.

Performing the above-described operation causes first a heater current IH0 to flow into the heater 2010, secondly a heater current IH1 to flow into the heater 2011, and thirdly a heater current IH2 to flow into the heater 2012 in the block period 301. The heater 2011 energized by the heater current IH1 generates heat to discharge ink. In the block period 301, the heater 2011 is a heater targeted for use for discharging ink. The heater 2010 energized by the heater current IH0 generates heat, but no bubble is formed in the liquid. The ink is not discharged by this heat generation. The heater 2012 energized by the heater current IH2 generates heat, but no bubble is formed in the liquid. The ink is not discharged by this heat generation. In the block period 301, the heaters 2010 and 2012 are heaters non-targeted for use for discharging ink.

The block period 302 is described below. The input of a pulse BLK1 of the latch signal (LT) starts the block period 302. In the block period 302, the ring shift register 209 switches the high-level period of the block selection signal 204 in the order of BLE3, BLE0, and BLE1. In this period, the heater currents IH3, IH0, and IH1 flow in turn to each heater, and the heater 2010 energized by the heater current IH0 generates heat to discharge ink. In the block period 302, the heater 2010 is a heater targeted for use for discharging ink. The heater 2013 energized by the heater current IH3 generates heat, but no bubble is formed in the liquid. The ink is not discharged by this heat generation. The heater 2011 energized by the heater current IH1 generates heat, but no bubble is formed in the liquid. The ink is not discharged by this heat generation. In the block period 302, the heaters 2011 and 2013 are heaters non-targeted for use for discharging ink.

Similarly, in the block periods 303 and 304, the ring shift register 209 performs the similar operation. In the block period 301, the above-described operation causes the heater 2011 to discharge ink. In the block period 302, the heater 2010 operates to discharge ink. In the block period 303, the heater 2013 operates to discharge ink. In the block period 304, the heater 2012 operates to discharge ink.

In the above description, attention is focused on one group (Gr.0). Other groups (Gr.1 and Gr.2) in one block period are subjected to similar control to drive a heater targeted for use for discharging ink in each group. In the block period 301, the heaters 2011, 2015, 2019, . . . , and 2039, for example, are driven. In FIG. 3, the sum of current flowing to the heaters is indicated by IH_SUM. Current IH_SUM as illustrated in FIG. 3 flows into the VH input terminal of the heat power source input unit 206 in FIG. 2 in the element substrate 807. Thus, if a heater targeted for use for discharging ink is selected by the ring shift register 209 with current flowing into the element substrate 807, the width of the rising and the falling time of the heater current can be decreased.

In the operation timing illustrated in FIG. 3, a parasitic impedance, a time width corresponding to the heat quantity by which ink can be discharged, and the width of the rising and the falling time of the heater current are previously obtained. The control unit 813 illustrated in FIG. 1 controls a signal output to the element substrate 807 based on these values.

Supplementarily, the rising and falling waveforms of an actual rectangular signal (a rectangular wave) are slightly dulled. This is caused by the influence of the driving capacity (a through rate) of a transistor if the switch 202 is a transistor, and the influence of a parasitic capacitance in the element substrate 807 in a moment when a heater current is switched in the element substrate 807. The parasitic capacitance in the element substrate 807 is in the order of several pico-farads (pF) to several tens of pico-farads (pF) and is smaller by about two digits than the parasitic capacitance outside the element substrate 807. For this reason, the influence of the parasitic capacitance in the element substrate 807 is smaller than that of the parasitic capacitance outside the element substrate 807.

If the heat quantity is increased by the heater non-targeted for use for discharging ink, current flowing to heaters other than heaters targeted for use for discharging ink may be divided and allocated to a plurality of heaters (a pulse is made short and allocated). The switching of the block selection signal 305 in each block period is determined so that current flowing into the element substrate 807 is kept constant before and after of energization timing of the heater targeted for use for discharging ink in each block period.

FIGS. 4A to 4D illustrate current waveforms in the first exemplary embodiment. A current waveform 101 flowing into the element substrate 807 is similar to a conventional waveform and the rising and falling waveforms are dulled. However, the configuration of the first exemplary embodiment suppresses the dullness of the rising and falling current waveforms 103 flowing to the heater for use for actually discharging ink (the heater targeted for use for discharging ink). Thus, the parasitic inductance and capacitance outside the element substrate 807 do not affect the heater targeted for use for discharging ink. The current waveform 104 of the heater targeted for use for discharging ink in energizing all nozzles can be made equal to the current waveform 105 of the heater targeted for use for discharging ink in energizing one nozzle. The quantity of discharge of ink can be uniform irrespective of the number of heaters to be energized at the same time.

Figure 5:
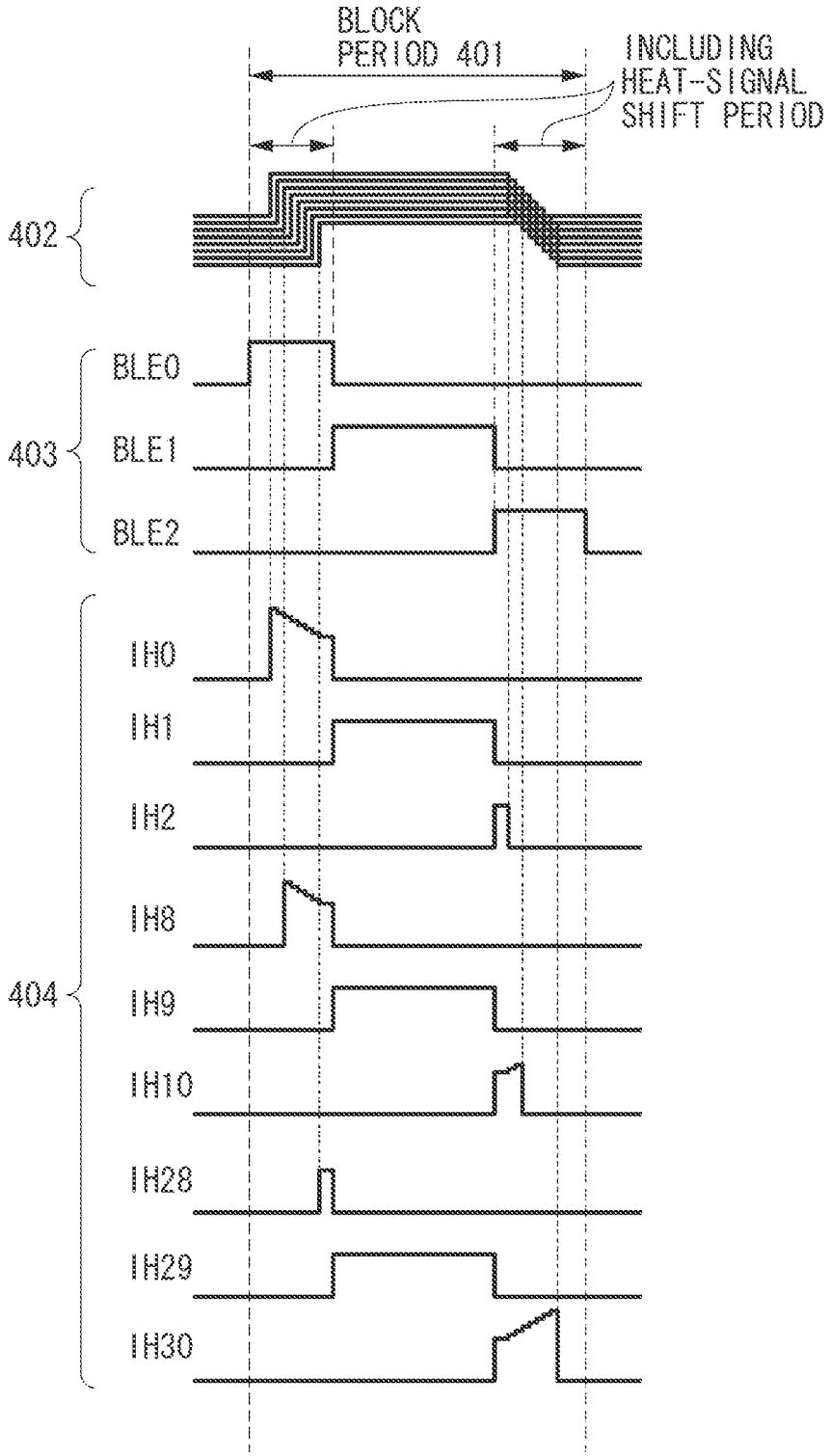
FIG. 5 illustrates current waveforms obtained by applying the first exemplary embodiment to heat shift control.

The configuration of the first exemplary embodiment may be applied to that of Japanese Patent Application Laid-Open No. 2002-292875 that the power source regulator is further provided or may be applied to control for shifting a driving timing discussed in Japanese Patent Application Laid-Open No. 07-68761. FIG. 5 illustrates an example in which the first exemplary embodiment may be applied to Japanese Patent Application Laid-Open No. 2002-292875. As is the case with the case illustrated in FIGS. 4A to 4D, only an area where current is kept at a constant level among the currents flowing to the element substrate can be supplied to a discharge heater. This enables the image quality and durability of the heater to be increased.

Figure 6:
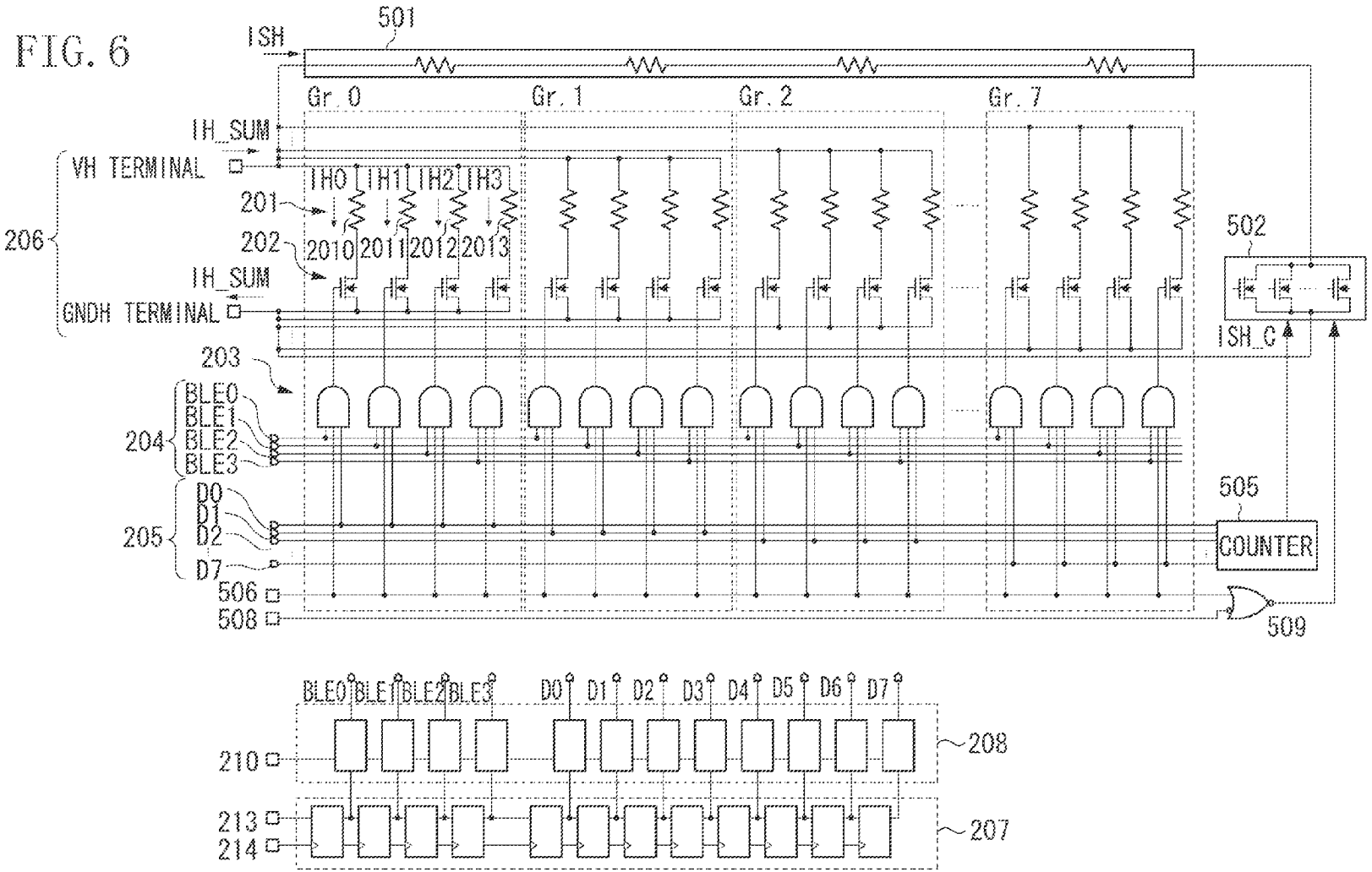
FIG. 6 is an internal configuration of an element substrate according to a second exemplary embodiment.

A second exemplary embodiment is described below. FIG. 6 illustrates an internal configuration of an element substrate 807 according to the second exemplary embodiment. The following describes points where the second exemplary embodiment is different from the first exemplary embodiment, but does not describe points where the second exemplary embodiment is similar to the first exemplary embodiment.

The element substrate 807 is provided with a sub-heater 501, a sub-heater driver 502, a counter 505, and a NOR circuit 509 as well as a heater 201 and a switch 202. The sub-heater 501 is a dedicated heater for heating the element substrate 807. The heater 201 is a heater used for discharging ink. The sub-heater driver 502 energizes (drives) the sub-heater 501. The sub-heater driver 502 drives the sub-heater 501 while a sub-heater drive signal (SHD) is in a high-level state. Voltage for energizing the sub-heater 501 is input from a VH terminal from which voltage for energizing the heater 201 is input.

The NOR circuit 509 is a logic operation unit for performing NOT-OR operation. The NOR circuit 509 receives the inversion signal of a sub-heat signal and the heat signal to generate the sub-heater drive signal (SHD). The NOR circuit 509 drives only any one of the heater 201 and the sub-heater 501, but does not drive the heater 201 and the sub-heater 501 at the same time.

The sub-heater driver 502 is provided with a current adjustment function. A current value is determined based on the output of an adjustment signal (ISH_C) output by the counter 505. The counter 505 receives the group election signals D0 to D7 to count the number of heaters driven at the same time for each block period. The counter 505 controls the sub-heater driver 502 to flow the current equal to the sum of heater currents in each block period. In the second exemplary embodiment, the values of the block and group selection signals are fixed in the block period. The group selection signal is updated according to image data for each block.

Figure 7:
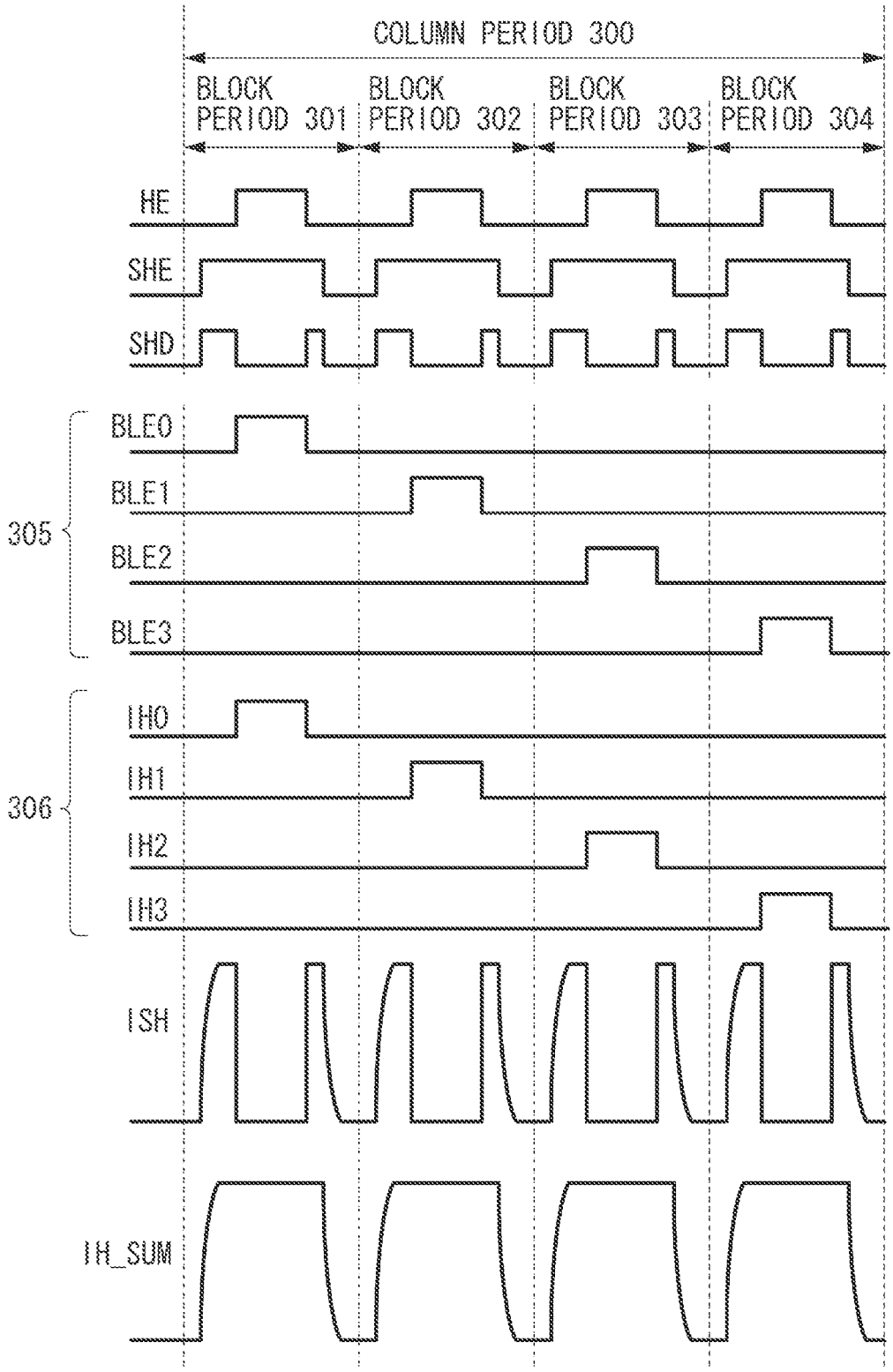
FIG. 7 illustrates an operation of the element substrate according to the second exemplary embodiment.

FIG. 7 is a timing chart of the element substrate illustrated in FIG. 6. The following describes points where the second exemplary embodiment is different from the first exemplary embodiment, but does not describe points where the second exemplary embodiment is similar to the first exemplary embodiment. The heater 201 to be used for recording (a heater targeted for use for discharging ink) is energized in any of the block period. In FIG. 7, description is made with attention focused on the group 0 (Gr.0) illustrated in FIG. 6. The latch signal (LT) is omitted in FIG. 7 to simplify FIG. 7.

FIG. 7 illustrates that the circuit of the element substrate 807 is operated to flow the current IH_SUM to the sub heater 501 in the rising and falling period of the current IH_SUM input to the element substrate 807 and flow the current IH_SUM to the heater 201 in the period for which the value of the current IH_SUM is kept constant.

The time width of the sub-heat signal (SHE) in a high-level state is longer than the time width of the heat signal (HE) in a high-level state. The heat signal is input from an HE terminal 506 and the sub-heat signal is input from an SHE terminal 508 to include a high-level period of the heat signal.

A control operation for energizing the heater is described below. The latch 208 brings BLE0 to a high level in the block period 301. The latch 208 brings BLE1 to a high level in the block period 302. The latch 208 brings BLE2 to a high level in the block period 303. The latch 208 brings BLE3 to a high level in the block period 304. As described above, the AND circuit 203 outputs a signal to a corresponding driver 202 by inputting the block selection signal to each AND circuit 203. This flows the heater current IH0 to the heater 2010 in the block period 301. The heater current IH1 flows to the heater 2011 in the block period 302. The heater current IH2 flows to the heater 2012 in the block period 303. The heater current IH3 flows to the heater 2013 in the block period 304.

The above description is made with attention focused on one group (Gr.0), but the similar control is performed on other groups (Gr.1 and Gr.2) in one block period to drive the heater targeted for use for discharging ink from each group. In FIG. 7, the sum of current flowing to the heaters is indicated by IH_SUM. Current IH_SUM as illustrated in FIG. 7 flows into the VH input terminal in FIG. 6 in the element substrate 807.

Thus, if the sub heater 501 and the heater 201 are switched with current flowing into the element substrate 807, the width of the rising and the falling time of the heater current can be decreased.

The element substrate 807 is configured such that the sub heater 501 and the heater 201 are supplied with power from the same VH terminal. The current IH_SUM input to the element substrate 807 is switched (shifted) between the sub heater current (ISH) and the heater current 606 to allow suppressing the dullness of the rising and falling waveforms of the heater current 606. Although dull current is applied to the sub heater, the sub heater aims to heat the element substrate, so that influence is small.

An ink-discharge time period and the width of the rising and the falling time of the sub-heater current are previously measured. Alternatively, the values of power applied to the heater in the width of the rising and the falling time are previously obtained. The timing of operation illustrated in FIG. 7 is determined based on these values. The control unit 813 in FIG. 1 controls a single output to the element substrate 807 based on these values.

Figure 8:
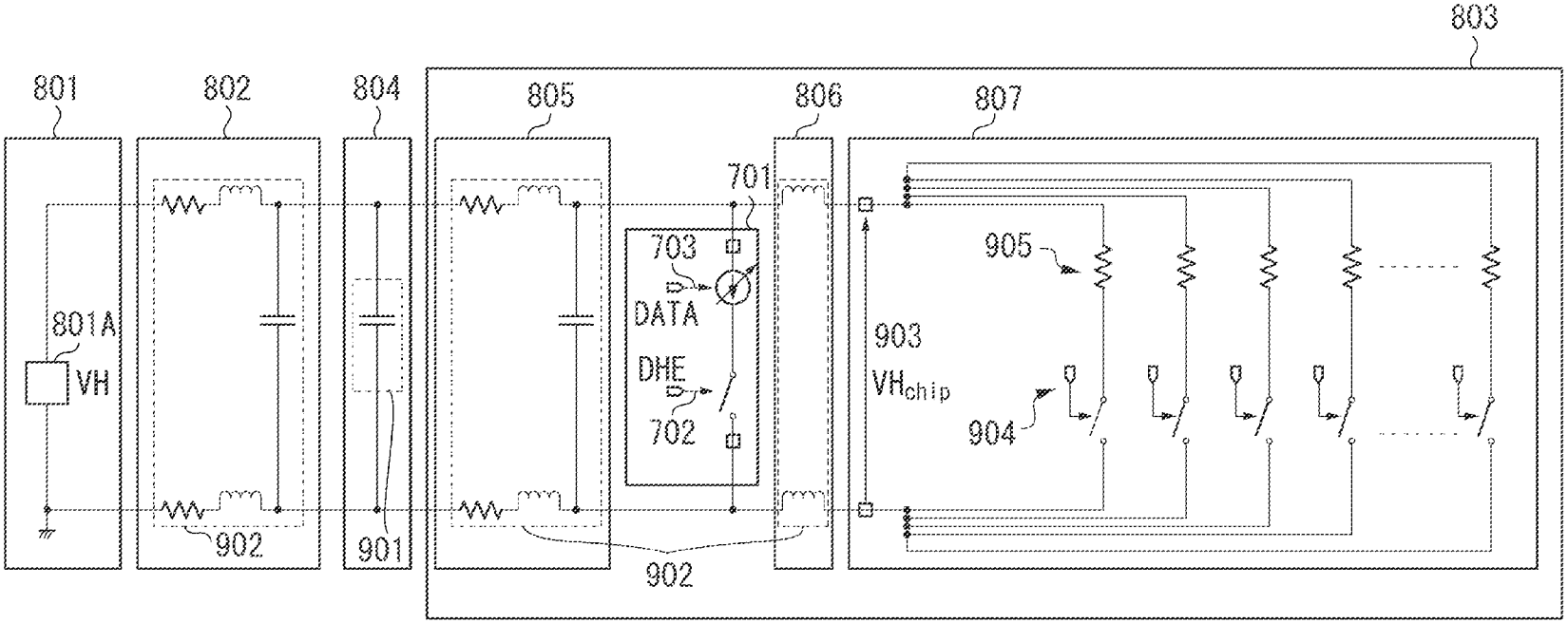
FIG. 8 illustrates an internal configuration of a liquid discharge head according to a third exemplary embodiment.

A third exemplary embodiment is described below. FIG. 8 illustrates an internal configuration of a liquid discharge head according to the third exemplary embodiment. A liquid discharge head 803 is provided with a dummy current drive substrate 701 as well as the element substrate 807. The dummy current drive substrate 701 is provided in the vicinity of the heater power-source wire of the element substrate 807. This configuration significantly lowers a parasitic impedance between the dummy current drive substrate 701 and the element substrate 807. The flexible printed-circuit board (FPC) 805 and the wire bonding 806 are represented as a first unit, the element substrate 807 is represented as a second unit, and the dummy current drive substrate 701 is represented as a third unit.

The dummy current drive substrate 701 is provided with circuits equivalent to the sub-heater driver 502 and the counter 505 described in the second exemplary embodiment. Adjustment is made to flow current equal in value to the current flowing to the element substrate 807. A dummy heat signal (DHE) similar to the sub-heat signal (SHE) illustrated in FIG. 7 is input to a dummy heat signal input 702.

Figure 9:
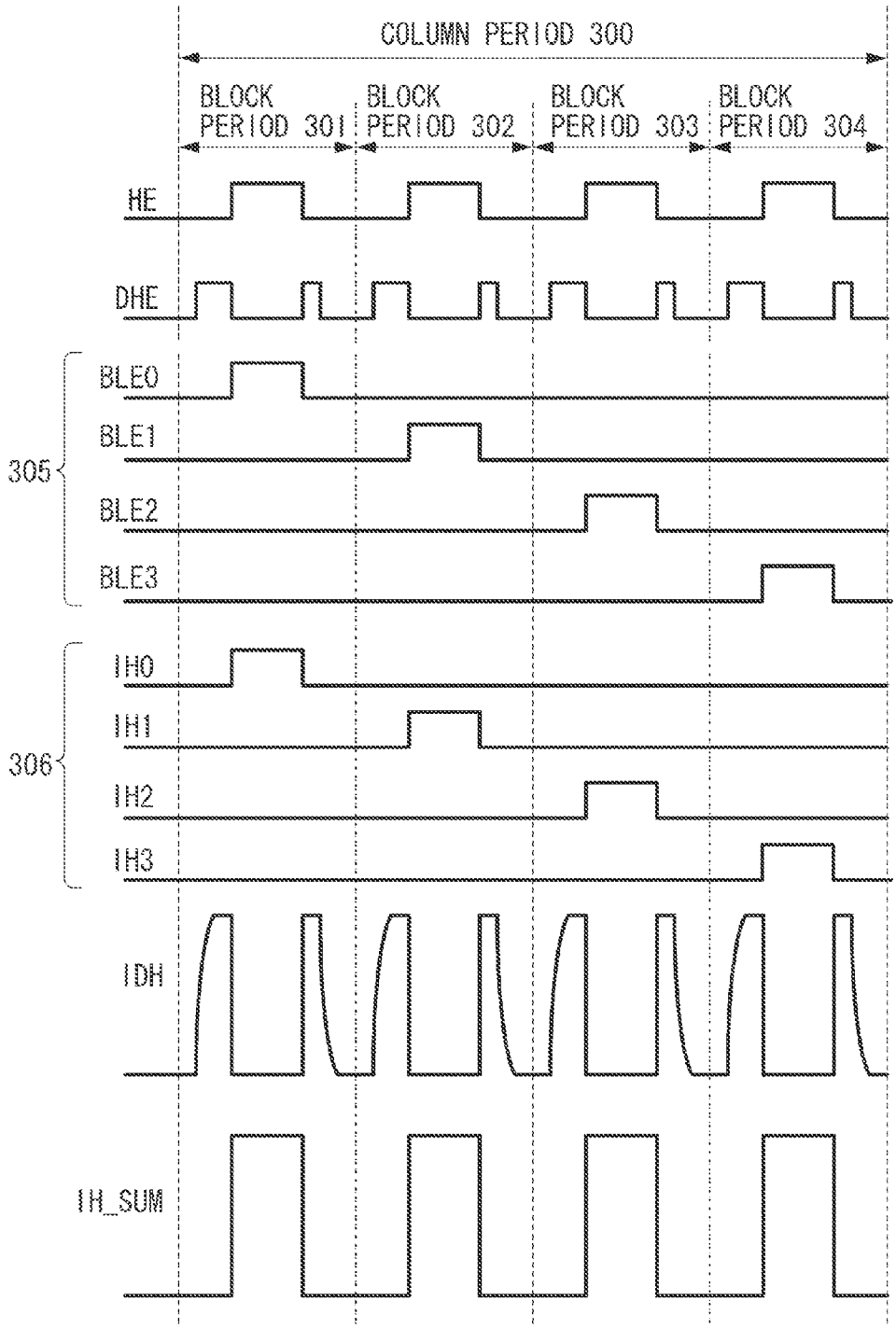
FIG. 9 illustrates the operation of an element substrate and a dummy substrate according to the third exemplary embodiment.
Figure 10:
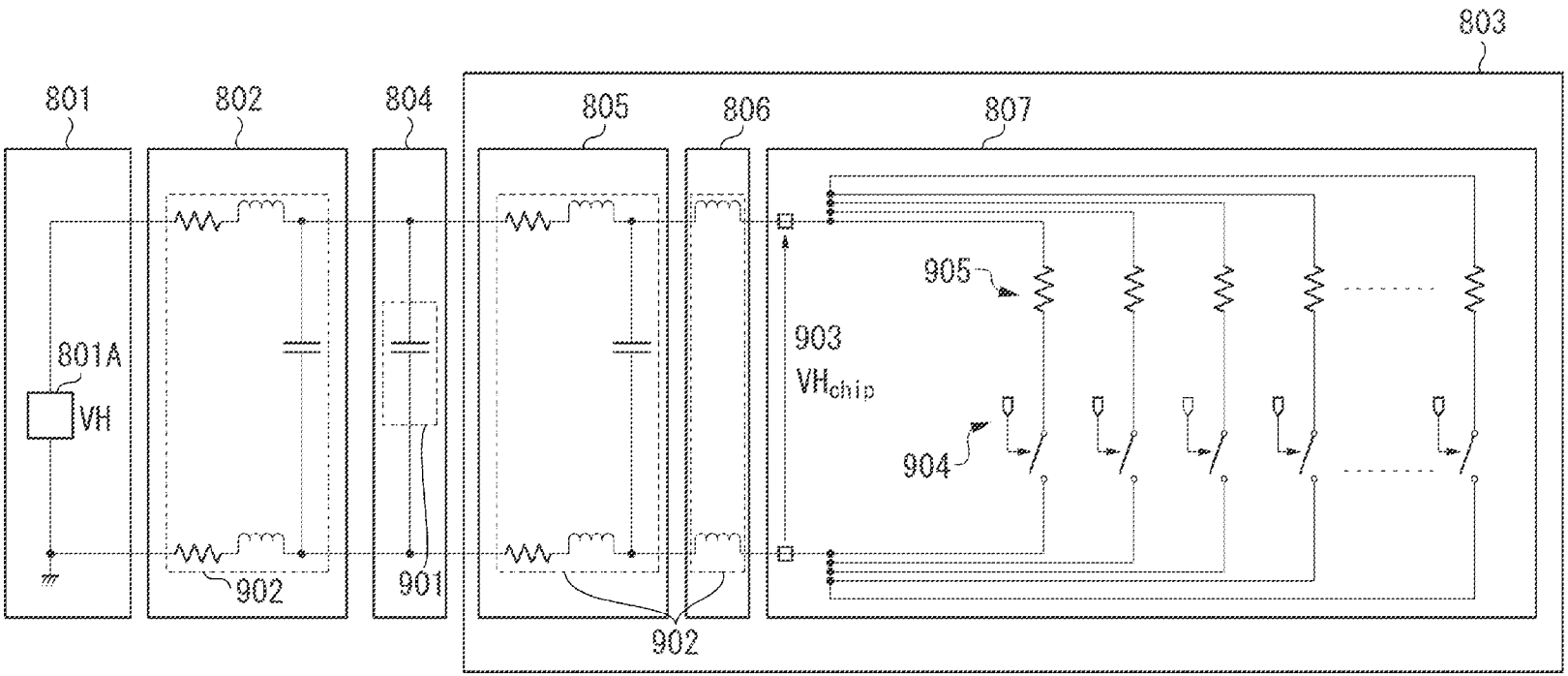
FIG. 10 illustrates the element substrate and a power supply line to the element substrate for describing problems to be solved.
Figure 11:
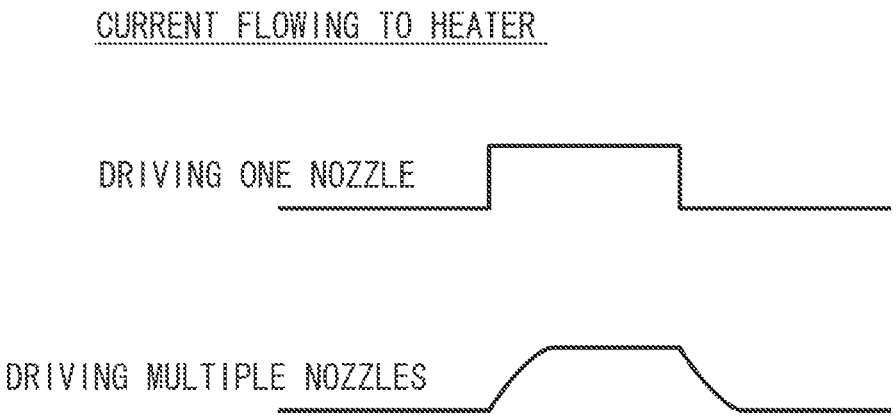
FIG. 11 illustrates current waveforms for describing problems to be solved.
Figure 12:
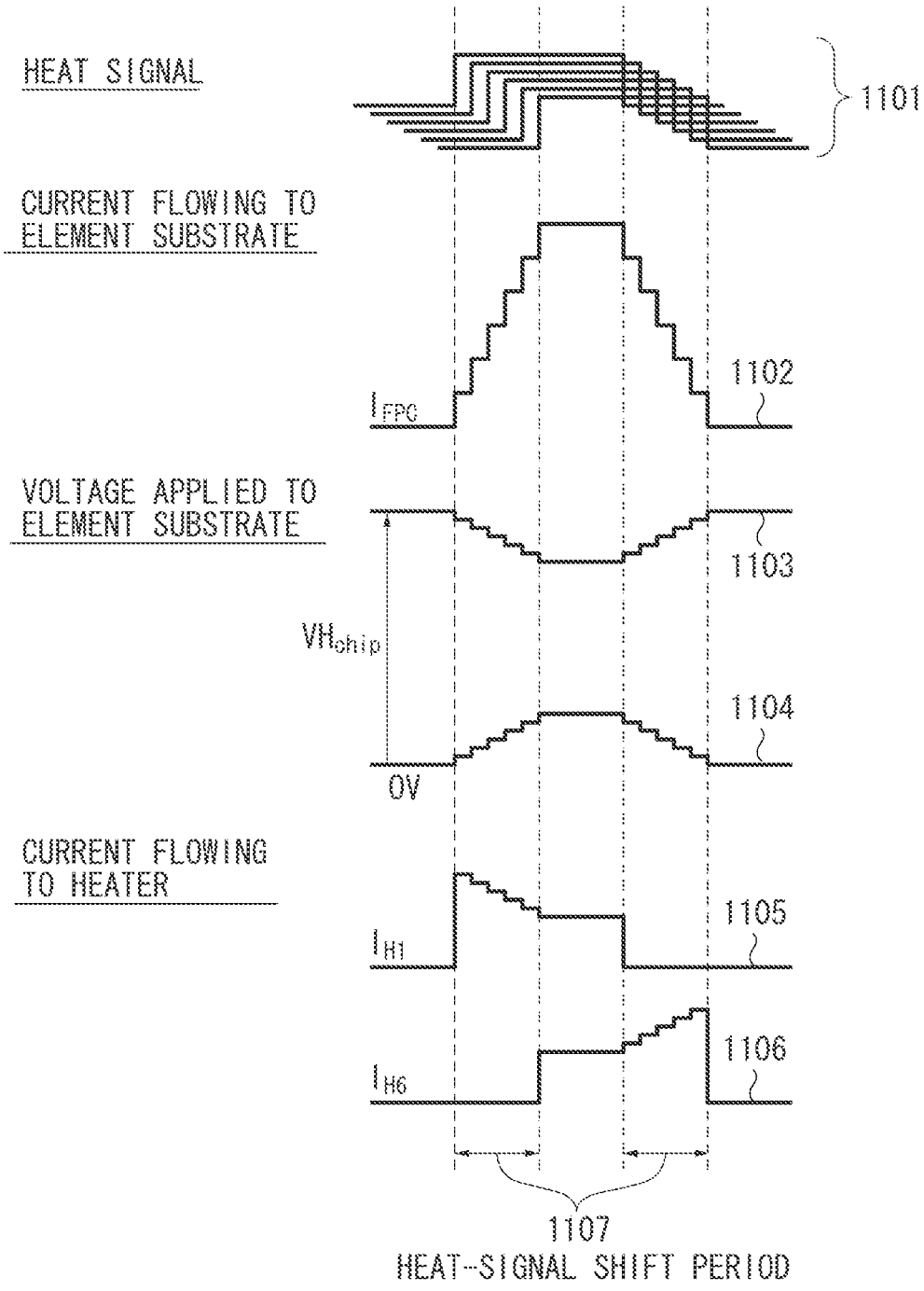
FIG. 12 illustrates current waveforms for describing problems to be solved.

FIG. 9 illustrates the operation of the element substrate 807 and the dummy substrate 701. The following describes points where the third exemplary embodiment is different from the second exemplary embodiment, but does not describe points where the third exemplary embodiment is similar to the second exemplary embodiment. Current IDH is supplied to a dummy heater based on the dummy heat signal (DHE) in each block period. The timing in FIG. 9 refers to a period before and after current IH_SUM is input to the element substrate 807. Current thus flows to suppress the dullness of the rising and falling waveforms of current flowing to each heater of the element substrate 807. In the first and second exemplary embodiments, current flows to the element substrate 807 in the rising and falling periods to generate heat which is not used for discharging ink. In the third exemplary embodiment, however, heat which is not used for discharging ink is not generated in the element substrate 807. This allows minimizing an increase in temperature of the element substrate 807. Thereby, a variation in temperature of the element substrate 807 can be suppressed to allow realizing a stable print quality.

Although the above exemplary embodiments are described using a serial-type inkjet recording apparatus as an example, the exemplary embodiments can be applied to a full-line-type inkjet recording apparatus provided with a line-type liquid discharge head.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-191429 filed Aug. 31, 2012, which is hereby incorporated by reference herein in its entirety.

What is claimed is:

1. A liquid discharge head comprising:

a first unit configured to supply power; and a second unit including an input unit to which the power is input, a plurality of heaters connected to the input unit via a common power source line and operative to discharge liquid, an energization unit configured to energize the plurality of heaters, and a selection unit configured to select at least one target heater from the heaters to be energized with a predetermined current for discharging liquid, a block period comprising a discharge period during which the at least one target heater is energized, and a non-discharge period during which a plurality of non-target heaters are energized; the non-discharge period comprising a plurality of intervals;

wherein the selection unit is further configured to select non-target heaters from the heaters to be energized for discharging liquid, the selected non-target heaters being different from the target heater and the non-target heaters are energized for an interval occurring before and a different interval occurring after the target heater is energized, and wherein the energization unit is further configured to energize each of the target heater with the predetermined current for discharging liquid selected by the selection unit and the non-target heaters with the predetermined current for a predetermined time respectively, the target heater for discharging liquid is energized for a first period corresponding to a time interval at which the liquid is discharged, and the non-target heaters are energized for a second period corresponding to a time interval at which liquid is not discharged.

2. The liquid discharge head according to claim 1, wherein the energization unit is configured to energize the non-target heater for the predetermined time determined based on a parasitic impedance of the first unit.

3. The liquid discharge head according to claim 1, wherein the energization unit is configured to energize the non-target heaters different from the target heater such that no bubble is formed in liquid for use for discharging liquid.

4. A liquid discharge head comprising:

a first unit configured to supply power; and a second unit including an input unit to which the power is input, a plurality of first heaters configured to discharge liquid and a second heater that does not contribute to discharge of liquid and is a heater for heating an element substrate on which the first heaters are formed, the first and second heaters being connected to the input unit via a common power source line, an energization unit configured to energize the plurality of first heaters and the second heater, and a selection unit configured to select the first heaters to be energized with a predetermined current by the energization unit, a block period comprising a discharge period during which the at least one target heater is energized, and a non-discharge period during which a plurality of non-target heaters are energized; the non-discharge period comprising a plurality of intervals;

wherein the energization unit is further configured to energize the second heater for an interval occurring before and a different interval occurring after the first heater is energized, and wherein the energization unit is further configured to energize each of the first heaters selected by the selection unit with the predetermined current and the second heater with the predetermined current for a predetermined time respectively, the first heaters for discharging liquid are energized for a first period corresponding to a time interval at which liquid is discharged, and the second heater is energized for a second period corresponding to a time interval at which the element substrate is heated.

5. The liquid discharge head according to claim 4, wherein the energization unit is further configured to energize the second heater for the predetermined time determined based on a parasitic impedance of the first unit.

6. The liquid discharge head according to claim 4, wherein no bubble is formed in liquid by heat generation due to energization of the second heater.

* * * * *